US007465000B2

(12) United States Patent
Huang

(10) Patent No.: US 7,465,000 B2
(45) Date of Patent: Dec. 16, 2008

(54) AUTOMATIC DRAWER SLIDE HOMING APPARATUS

(75) Inventor: Kuo-Sheng Huang, Taipei County (TW)

(73) Assignee: Nan Juen International Co., Ltd., Taipei County (TW)

( * ) Notice: Subject to any disclaimer, the term of this patent is extended or adjusted under 35 U.S.C. 154(b) by 0 days.

(21) Appl. No.: 11/594,788

(22) Filed: Nov. 9, 2006

(65) Prior Publication Data

US 2008/0111456 A1 May 15, 2008

(51) Int. Cl.
*A47B 88/00* (2006.01)

(52) U.S. Cl. ..... 312/333; 312/334.46

(58) Field of Classification Search ..... 312/333, 312/334.44, 334.46, 334.47, 334.6, 334.14, 312/334.25, 334.27
See application file for complete search history.

(56) References Cited

U.S. PATENT DOCUMENTS 6,652,050 B2 * 11/2003 Lin ..... 312/333
6,979,066 B2 * 12/2005 Yang ..... 312/333
7,077,487 B2 * 7/2006 Yang ..... 312/333
7,244,005 B1 * 7/2007 Lu ..... 312/333
2004/0183411 A1 * 9/2004 Boks ..... 312/333
2004/0227438 A1 * 11/2004 Tseng et al. ..... 312/333
2005/0093406 A1 * 5/2005 Yang ..... 312/333
2005/0104492 A1 * 5/2005 Chiu ..... 312/333

FOREIGN PATENT DOCUMENTS

EP 107525 * 5/1984 ..... 312/333

* cited by examiner

*Primary Examiner*—Hanh V Tran
(74) *Attorney, Agent, or Firm*—Bacon & Thomas, PLLC

(57) ABSTRACT

An automatic drawer slide homing apparatus includes a bottom rail, a fixed base fixed to the bottom rail, a slide base fixed to the fixed base, a middle rail under the slide base and embedded to the bottom rail, a slide groove in the slide base, first and second positioning indents proximate to both sides of the slide groove respectively, a sliding member embedded in the slide groove, an oscillating member connected to the sliding member, and a resilient member connected to both sides of the sliding member and coiled around the fixed base. The oscillating member is oscillated and fixed at the first and second positioning indents. The top rail and middle rail are moved to a position superimposed with the bottom rail by the resilience of the resilient member to return the drawer fixed to the top rail to its original position to achieve an automatic homing effect.

4 Claims, 7 Drawing Sheets

AUTOMATIC DRAWER SLIDE HOMING APPARATUS

BACKGROUND OF THE INVENTION

1. Field of the Invention

The present invention relates to an automatic drawer slide homing apparatus, and more particularly to an automatic drawer slide homing apparatus capable of increasing the length of embedding a middle rail onto a bottom rail by suspending a slide base, such that when a drawer is pulled out, the drawer can be supported to prevent a deformation of the rails.

2. Description of the Related Art

A general traditional hanging basket or drawer slide structure usually installs corresponding rollers on both sides of a cabinet, a rail disposed separately on both sides of the hanging basket or drawer, a roller installed separately on both sides of the rail, and a concavely curved guiding track disposed at a rear end of the rail, wherein the position of the guiding tracks is lower than that of the rails. Although the rollers can be rolled to move the hanging basket or drawer along the guiding track of a rail, and a slope is formed naturally between the guiding track and the rail, and the weight of the hanging basket or drawer can position the drawer at a fixed position, yet the hanging basket or drawer has its own weight and carries heavy objects, and a certain pressure exerted on the guiding track will deform the guiding track, and the slope between the rail and the guiding track will be changed from a smooth condition to a rough condition. As a result, the drawer will get stuck easily or become unsmooth in the process of pushing the drawer inward from the guiding track. Since the position of the guiding track is lower than that of the rail, users may find it difficult to move the drawers containing heavy objects from the guiding track towards the rail, and such application definitely requires improvements.

Referring to FIG. 1 for R.O.C. Pat. No. 504988, an external slide element is provided for overcoming the foregoing shortcomings, and the external slide element includes an external fixed base fixed at an end of the slide element, a quick restoring element that freely slides back and forth in the fixed base, and a resilient element coiled around the periphery of the fixed base and having both ends fixed to the quick restoring element. In the operation of pulling an internal slide element out from the drawer, an end of a pulling element hooks the quick restoring element to be displaced outward and latched at a final position of a path in the fixed base. In the meantime, the quick restoring element pulls the resilient element to a tense state, and then the internal slide element will shut the drawer, such that when the pulling element and the quick restoring element are engaged with each other, the resilient element in a tense state will pull the drawer back rapidly, so as to achieve the effect of automatically shutting the drawer. Although this patented invention can avoid the difficulty of pulling a drawer, the fixed base is fixed at an end of the external slide element and the quick restoring element is pivotally coupled to fixed base and an end of the external slide element, and thus the length of the slide element being embedded into the external slide element becomes relatively shorter. When the slide element moves outward with the internal slide element connected to the drawer, the drawer cannot be supported fully when the drawer is pulled out, and thus the drawer may become deformed. Since it is necessary to raise the quick restoring element in order to latch the pulling element, the quick restoring element may get stuck easily, and all these cause inconvenience to the use of drawers.

SUMMARY OF THE INVENTION

In view of the shortcomings of the prior art, the inventor of the present invention based on years of experience to conduct extensive researches, experiments and modifications, and finally developed an automatic drawer slide homing apparatus in accordance with the present invention.

A primary objective of the present invention is to overcome the shortcomings of the prior art by providing an automatic drawer slide homing apparatus capable of automatically positioning a drawer, and the apparatus comprises a bottom rail fixed onto an internal side of an object, a fixed base fixed at an end of the bottom rail, a slide base fixed at an end of the fixed base, a middle rail disposed under the slide base that is embedded onto the bottom rail, a slide groove disposed in the slide base, first and second positioning indents disposed respectively on both ends of the slide groove, a sliding member embedded in the slide groove, an oscillating member pivotally coupled to the sliding member, a resilient member disposed separately on both sides of the sliding member and coiled around the fixed base, a top rail embedded onto the middle rail and coupled to the drawer, and a position limit member latched under the top rail and having a protruding pillar disposed on the position limit member and extended towards the middle rail.

If the top rail is pulled together with the drawer outward, the protruding pillar of the position limit member will be latched at an end of the oscillating member, such that the oscillating member can be moved from the first positioning indent to the second positioning indent, and the resilient member connected to the oscillating member can be stretched accordingly, until the oscillating member latched at an end of the protruding pillar is separated from the protruding pillar, and another end of the protruding pillar is moved to the second positioning indent by the oscillation to position the oscillating member, and the top rail continues to move outward. If the drawer is moved back towards the object, the top rail will move towards the middle rail, and a curved surface of the top rail will press against an edge of the middle rail to drive the middle rail to move. If the position limit member is in contact with the oscillating member, the position originally latched to an end of the second positioning indent will be changed to latch an end of the position limit member with the protruding pillar and superimpose the top rail with the middle rail. The resilience of the resilient member will pull back the resilient member to return the drawer fixed to the top rail back into the object, so as to achieve an automatic homing effect. Since the slide base is suspended on the bottom rail, the middle rail can be penetrated into the bottom rail to increase its length, such that when the top rail is pulled outward, the top rail can be used for supporting the drawer and preventing possible deformations caused by the weight of the drawer.

BRIEF DESCRIPTION OF THE DRAWINGS

To make it easier for our examiner to further understand the shape, structure and performance of the present invention, preferred embodiments accompanied with their related drawings are used for the detailed description of the invention.

DETAILED DESCRIPTION OF THE PREFERRED EMBODIMENTS

Figure 1:
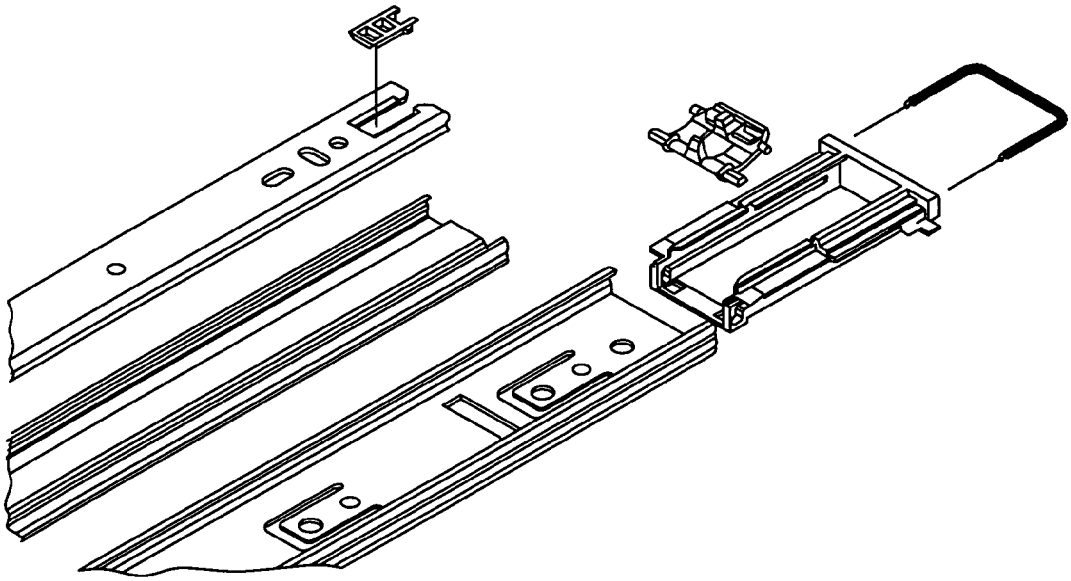
FIG. 1 (PRIOR ART)
FIG. 1 is a schematic view of a prior art apparatus.
Figure 2:
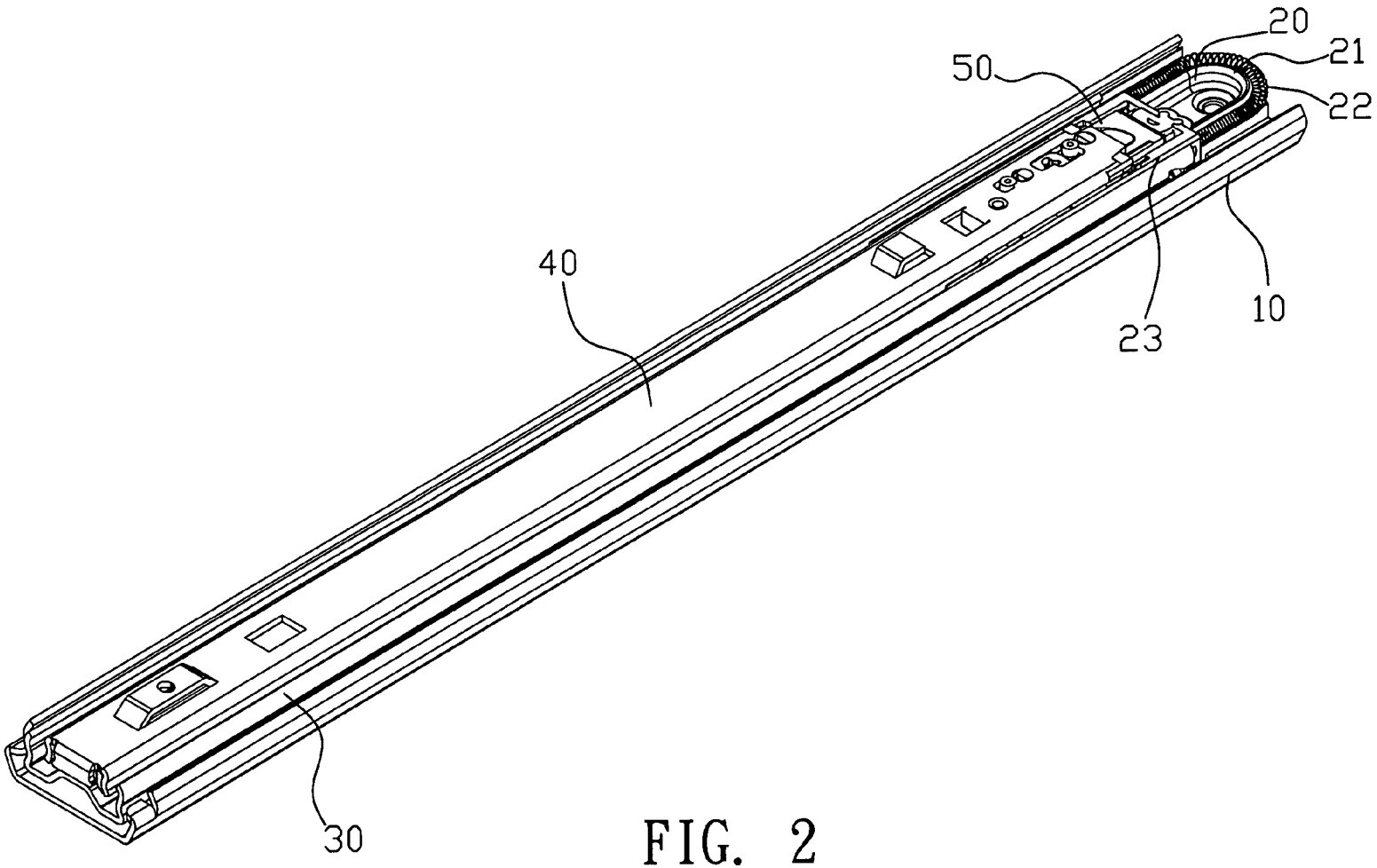
FIG. 2 is a perspective view of a preferred embodiment of the invention.
Figure 3:
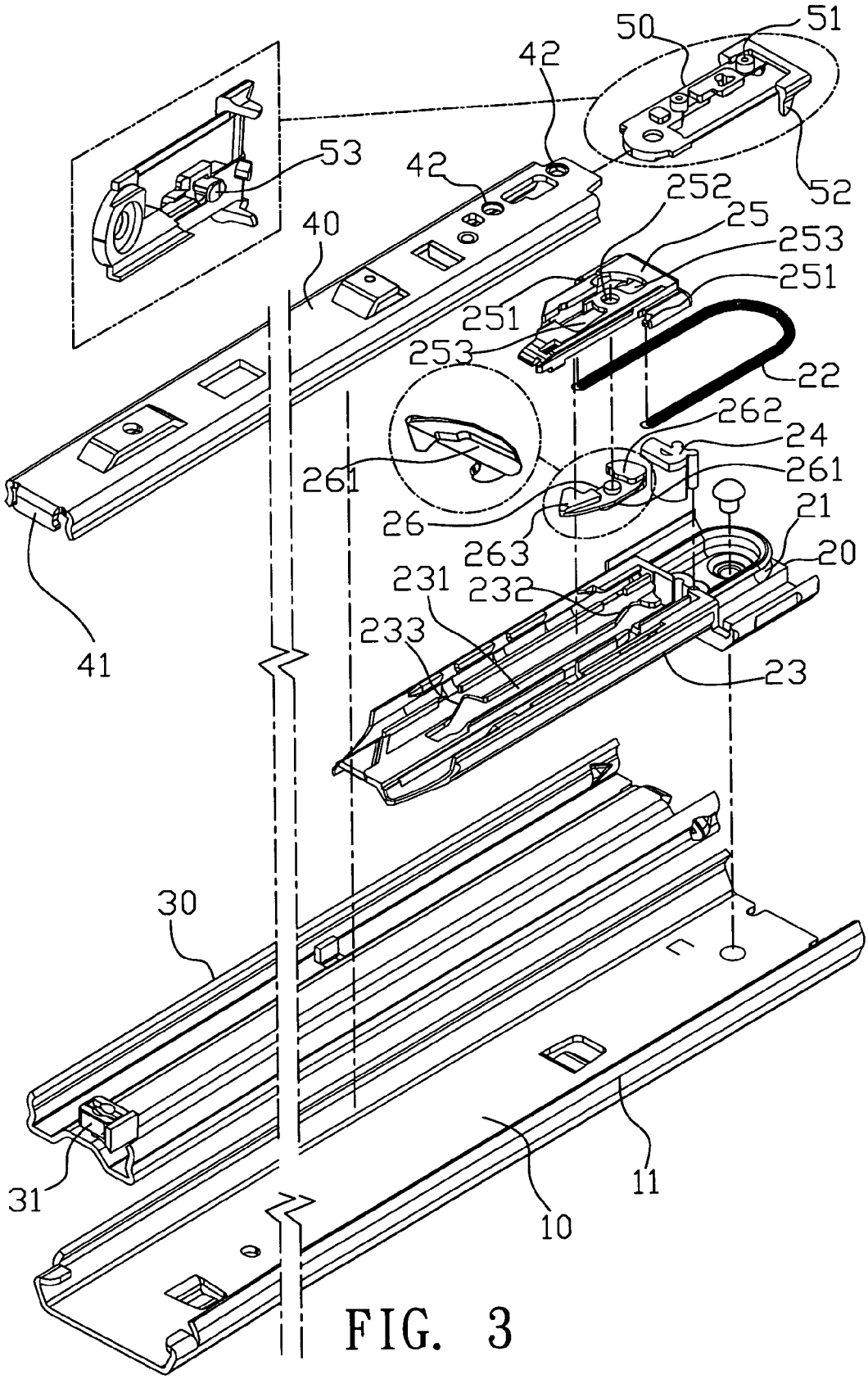
FIG. 3 is an exploded view of a preferred embodiment of the invention.
Figure 4:
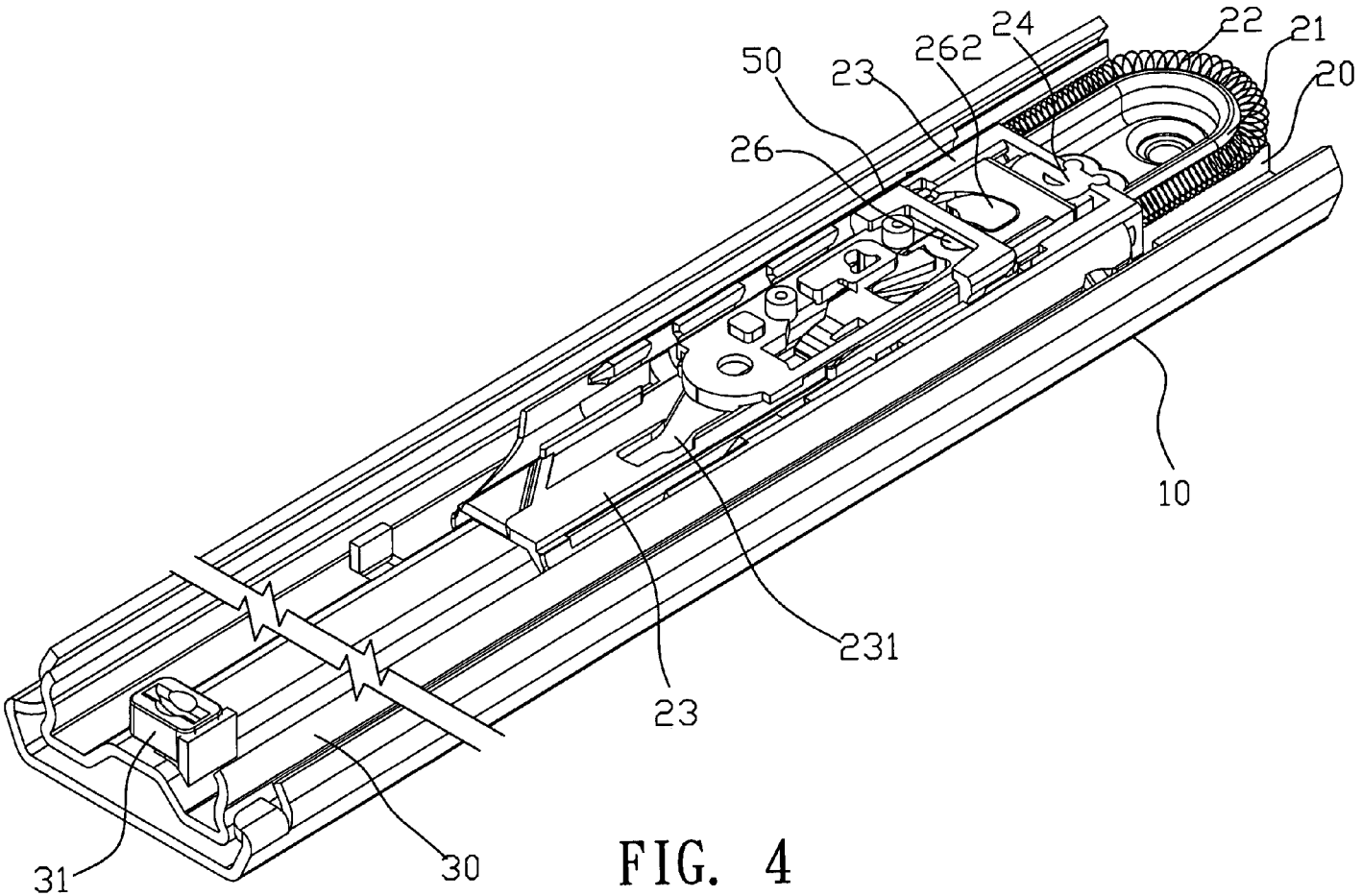
FIG. 4 is a schematic view of a partial assembly of the invention.

Referring to FIGS. 2 to 4 for an automatic drawer slide homing apparatus of the present invention, the automatic drawer slide homing apparatus is used for cabinets, and the structure comprises a bottom rail 10, which is a U-shaped frame, a side edge 11 disposed separately on both sides of the bottom rail 10 and having a certain curvature, a fixed base 20 fixed at an end of the bottom rail 10, a U-shape rail 21 disposed on the fixed base 20, a resilient member 22 coiled around the surface of the rail 21 (wherein the resilient member 22 of this embodiment is a spring), a slide base 23 coupled to an end of the fixed base 20 and suspended on the bottom rail 10, and a buffer 24 installed at an end of the fixed base 20 connected with the slide base 23, and the buffer 24 of this embodiment is a rubber pad used for absorbing vibrations.

Further, the slide base 23 comprises a slide groove 231, first and second positioning indents 232, 233 disposed on the slide groove 231 and proximate to both ends of the slide groove 231 respectively, a sliding member 25 embedded into the slide groove 231, a protruding latch point 251 disposed separately on both sides of the sliding member 25 for fixing both ends of resilient member 22, such that the resilient member 22 can be moved according to the sliding member 25 to produce a stretch or a deformation or resume the resilient member 22 to its original position. Further, the sliding member 25 has a pivot hole 252, and both sides of the pivot hole 252 have a separate open groove 253, and the pivot hole 252 has a pivotally connected oscillating member 26, and the oscillating member 26 has a protruding rib 261 disposed on a surface facing the slide base 23, and both lateral edges of another surface of the oscillating member 26 has first and second protrusions 262, 263 precisely and separately oscillated in the open groove 253.

Further, a middle rail 30 is disposed at an superimposed position of the slide base 23 and the bottom rail 10, and an end of the middle rail 30 is in contact with the fixed base 20, and another end of the middle rail 30 has a protruding stopping member 31, and the middle rail 30 has a top rail 40 embedded thereon and coupled with a drawer (not shown in the figure), and an end of the top rail 40 has a curved surface 41 for pressing a distal edge of the middle rail 30 proximate to the stopping member 31, and another distal edge of the middle rail 30 has an embedding hole 42 latched to a position limit member 50, and the position limit member 50 is installed between the top rail 40 and the middle rail 30, and the position limit member 50 has an embedding pillar 51 disposed thereon and corresponding to the embedding hole 42 for the embedding purpose, and both sides of the position limit member 50 respectively have a protruding tooth portion 52 for pressing a protruding latch point 251 disposed separately on both lateral edges of the sliding member 25, and the position limit member 50 has a protruding pillar 53 disposed on a surface facing the sliding member 25, and the protruding pillar 53 is operated in coordination with the oscillating member 26.

Figure 5:
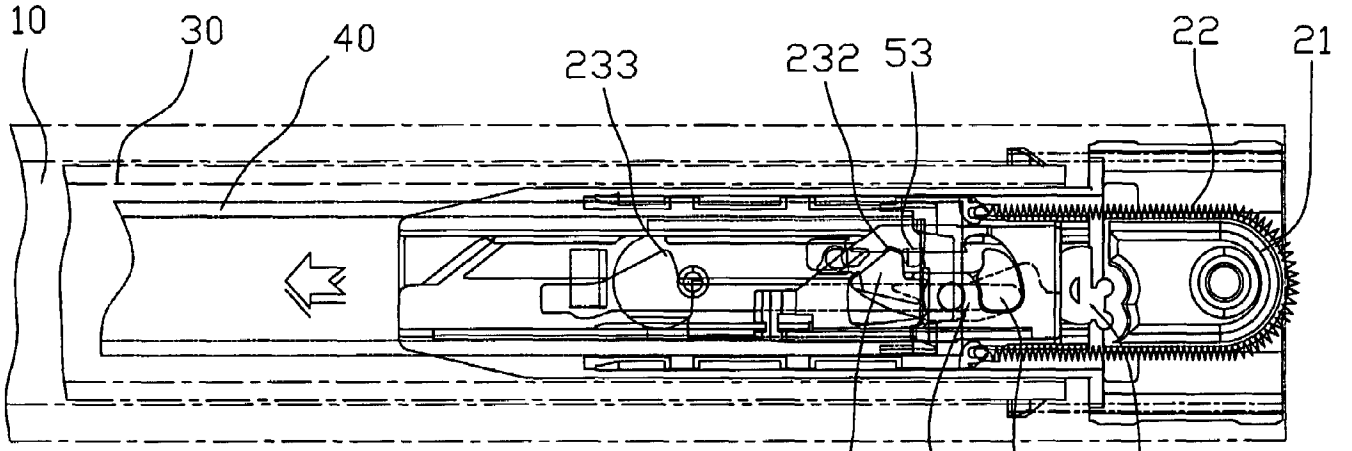
FIG. 5 is a schematic view of pulling out a drawer of the invention.
Figure 6:
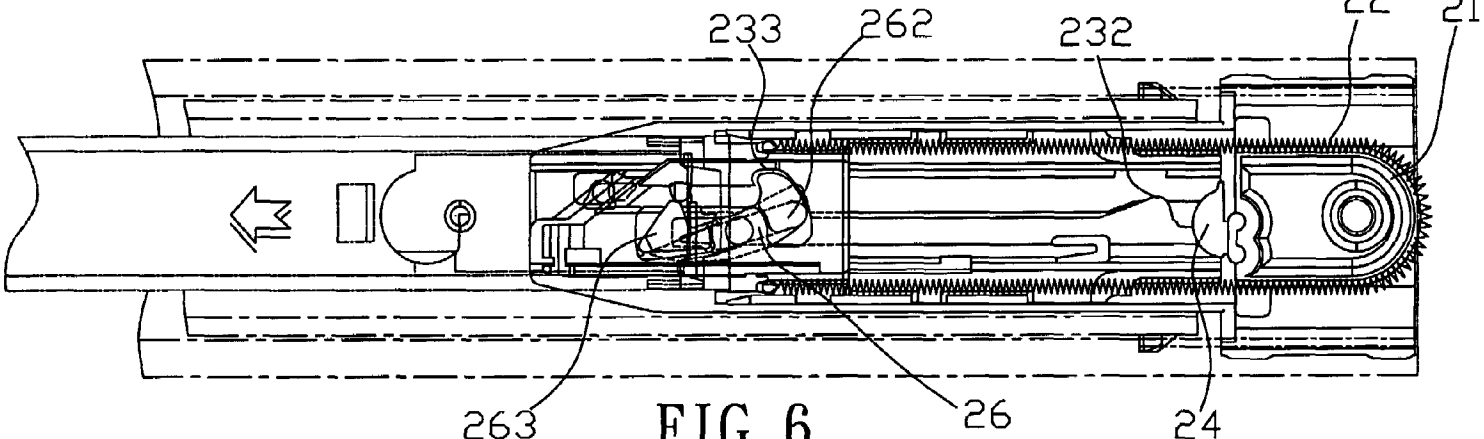
FIG. 6 is another schematic view of pulling out a drawer of the invention.
Figure 7:
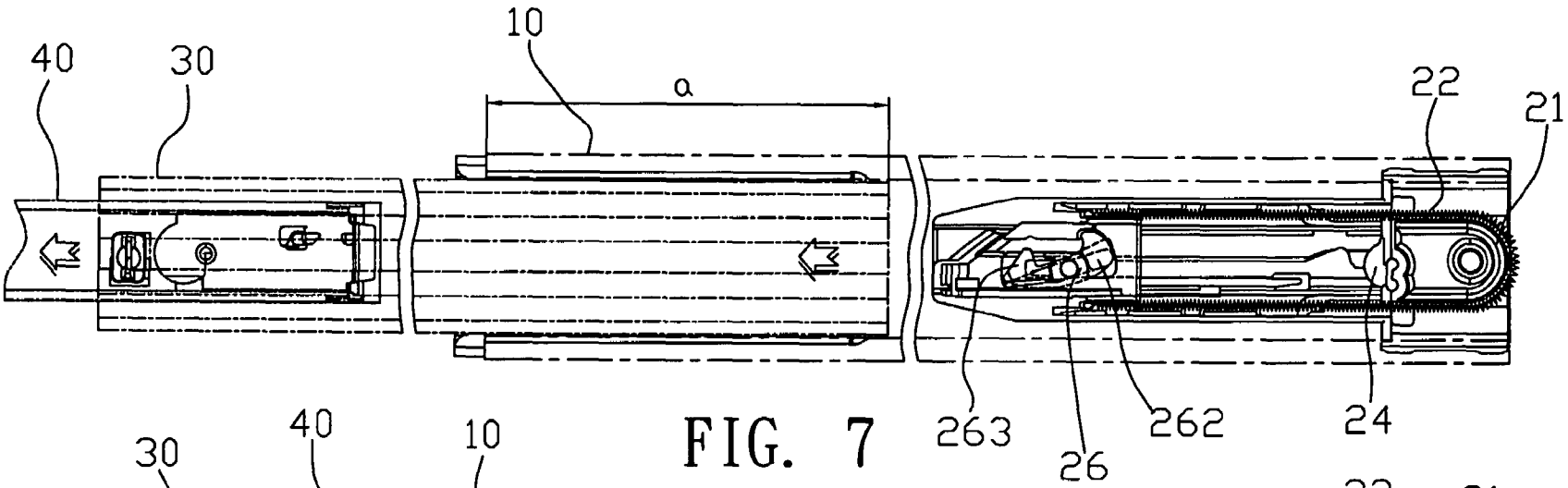
FIG. 7 is a further schematic view of pulling out a drawer of the invention.

Referring to FIGS. 5 to 7, the top rail 40 will move outward when the drawer is pulled out, and the position limit member 50 under the top rail 40 will move in the same moving direction of the top rail 40, such that the protruding pillar 53 of the position limit member 50 will be in touch with the second protrusion 263 of the oscillating member 26 to drive the oscillating member 26 to move in the slide groove 231, and the oscillating member 26 will be moved from the position of the first positioning indent 232 to the second positioning indent 233 to stretch the resilient member 22 installed on both sides of the sliding member 25. If the oscillating member 26 is moved to the position of the second positioning indent 233, the protruding pillar 53 will be separated from the oscillating member 26 and will continue moving forward. In the meantime, the first protrusion 262 of the oscillating member 26 will be moved according to the oscillation of the oscillating member 26 to enter into the second positioning indent 233, such that the oscillating member 26 can be fixed at its position instead of moving back and forth due to the deformation of the resilient member 22. As a result, the top rail 40 continues moving to drive the middle rail 30 to move forward untill the drawer is opened completely.

Figure 8:
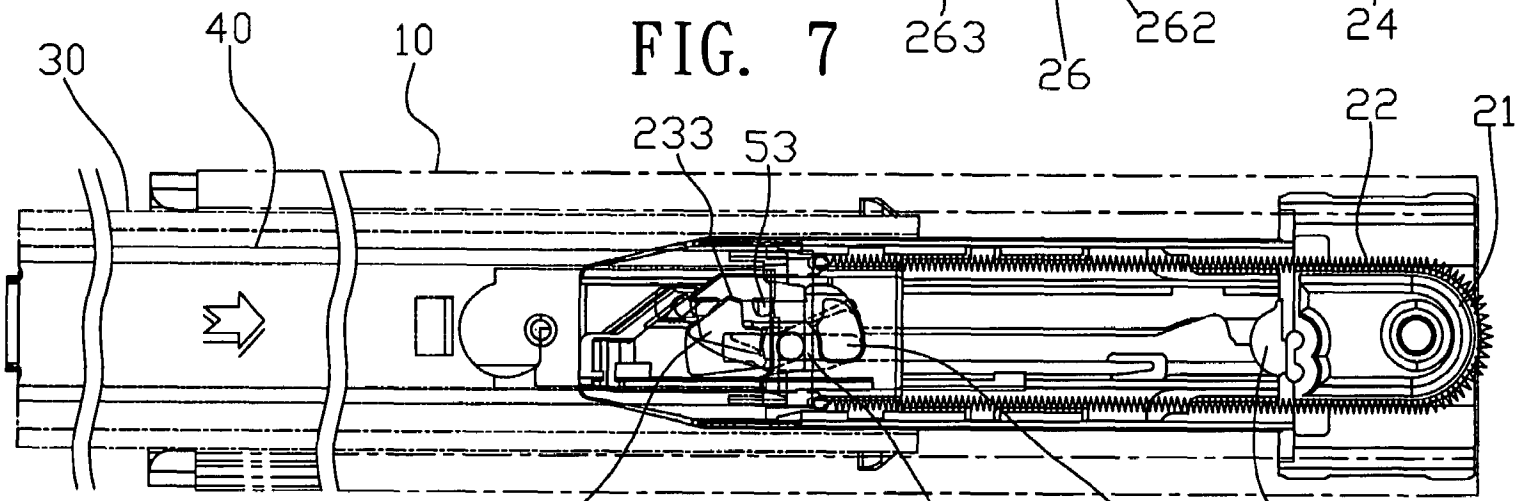
FIG. 8 is a schematic view of pushing in a drawer of the invention.
Figure 9:
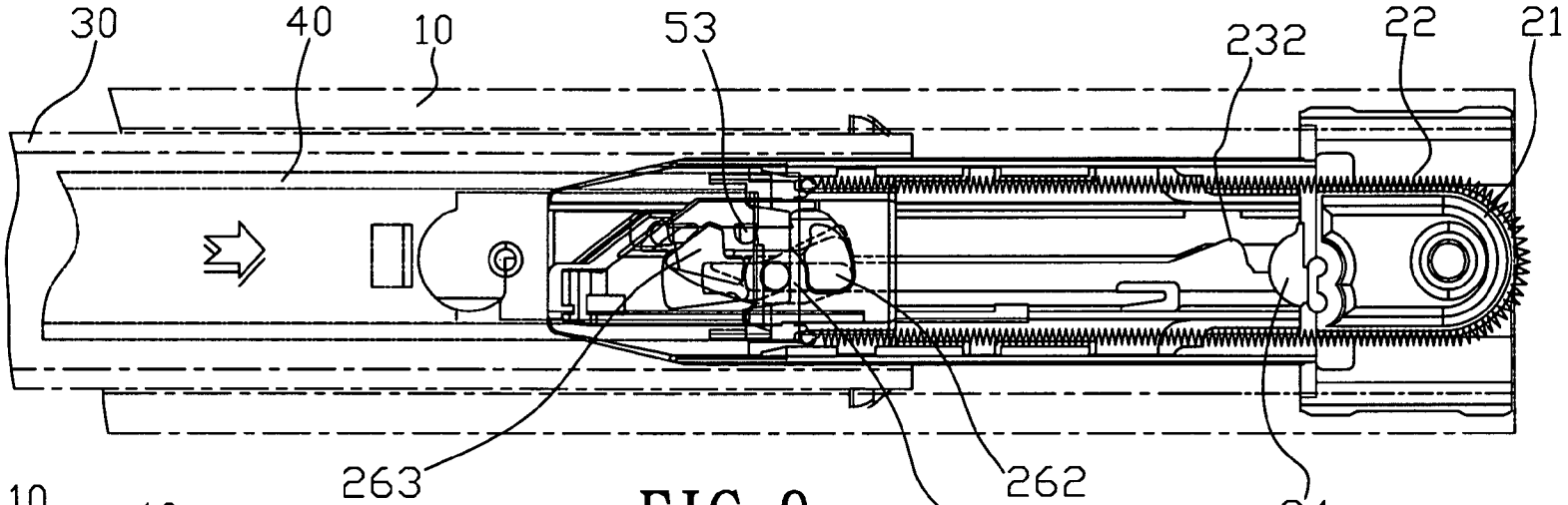
FIG. 9 is another schematic view of pushing in a drawer of the invention.
Figure 10:
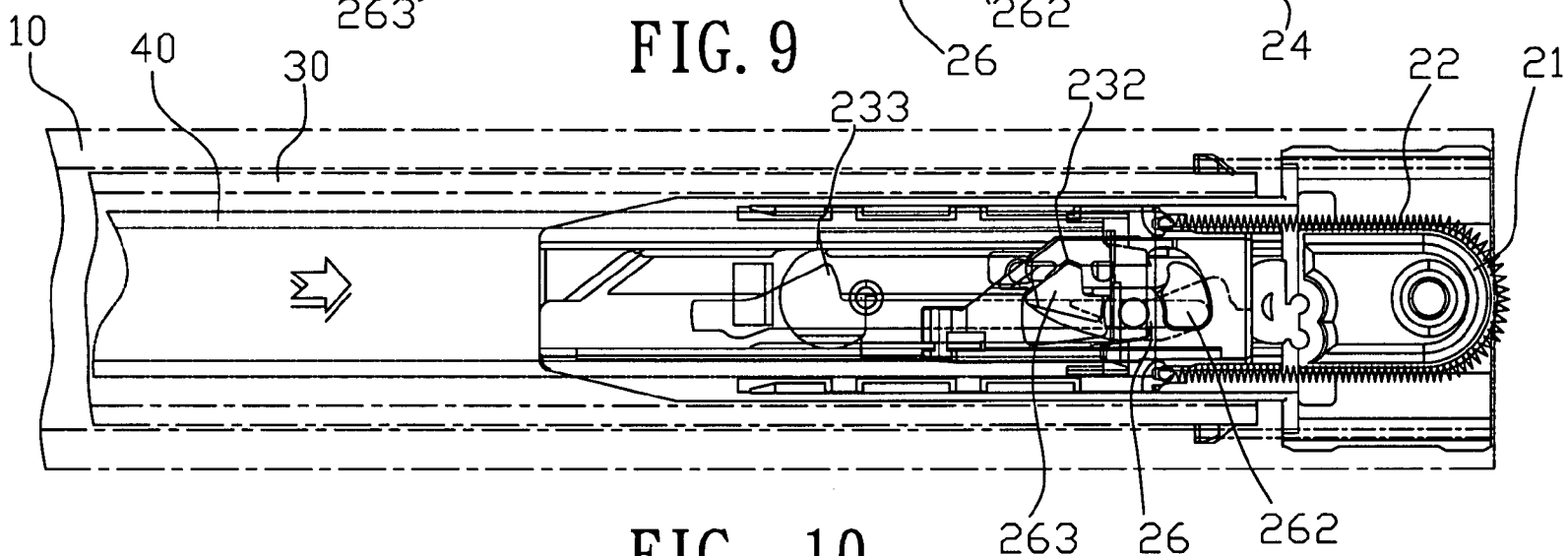
FIG. 10 is a further schematic view of pushing in a drawer of the invention.

Referring to FIGS. 8 to 10, the curved surface 41 of the top rail 40 presses at a distal edge of the middle rail 30 proximate to the stopping member 31 to drive the middle rail 30 to move together, until the protruding pillar 53 of the position limit member 50 is pressed on the first protrusion 262, if the drawer is pushed back. Therefore, the first protrusion 262 originally latched to the second positioning indent 233 is released from the limitation of the second positioning indent 233, so that the oscillating member 26 is moved towards the fixed base 20 by the stretched and deformed resilient member 22 to return the top rail 40 and the middle rail 30 back to their original positions, so as to achieve an automatic homing effect. Since the slide base 23 is suspended on the bottom rail 10, the middle rail 30 can be penetrated into the bottom rail 10 to increase its length, such that when the top rail 40 is pulled outward, the top rail can be used for supporting the drawer and preventing a possible deformation of the top rail 40 caused by the weight of the drawer.

In summation of the above description, the present invention herein enhances the performance and overcomes the shortcomings of the prior art, and further complies with the patent application requirements, and thus the invention is duly filed for patent application.

While the invention has been described by way of example and in terms of preferred embodiments, it is to be understood that the invention is not limited to such arrangement, and various modifications and similar arrangements and procedures are intended to be covered by the scope of the appended claims and should be accorded the broadest interpretation so as to encompass all such modifications and similar arrangements and procedures.

What is claimed is:

1. An automatic drawer slide homing apparatus, that is a positioning apparatus used for cabinets, and said apparatus comprising:

a bottom rail;

a fixed base, fixed at an end of said bottom rail, and having a slide base suspended from an end of said fixed base, such that said slide base maintains a predetermined distance from said bottom rail, and said slide base includes a slide groove located along a plane, and both ends of said slide groove have a first positioning indent and a second positioning indent respectively;

a sliding member, moved back and forth in said slide groove of said slide base;

a resilient member, coiled around said fixed base, and having both ends fixed at said sliding member;

an oscillating member, pivotally coupled to said sliding member, and having corresponding first and second protrusions, the oscillation of the oscillating member is generally arranged along the plane of the slide groove;

a middle rail, embedded onto said bottom rail, and superimposed under said slide base, and contacted with said fixed base;

a top rail, embedded onto said middle rail; and a position limit member, fixed at said top rail and disposed on a surface facing said middle rail, and said position limit member having a protruding pillar; such that when said top rail moves outward together with a drawer, said protruding pillar of said position limit member is latched at an end of said oscillating member, and said sliding member is driven to move accordingly, and said oscillating member is moved from said first positioning indent to said second positioning indent to stretch said resilient member coupled to said sliding member, until said oscillating member latched to an end of said protruding pillar is separated from said protruding pillar, and another end of said protruding pillar is moved into said second positioning indent to fix said oscillating member into a position and release said top rail from the limitation of said sliding member, and if said protruding pillar continues moving, said middle rail will be driven to move outward; and if said drawer is pushed back, said top rail will be moved towards said middle rail, and said protruding pillar of said position limit member will be in contact with said first protrusion of said oscillating member to change the position of said first protrusion originally latched to said second positioning indent, and said first protrusion will be moved correspondingly to release the limitation of said second positioning indent, so that said top rail and said middle rail will be superimposed, and the resilience of said resilient member will pull said resilient member back rapidly, such that said drawer fixed to said top rail will resume its position to an object, so as to achieve an automatic homing effect, and since said slide base is suspended on said bottom rail, said middle rail can be penetrated into said bottom rail to increase its length.

2. The automatic drawer slide homing apparatus of claim 1, wherein said resilient member is a spring.

3. The automatic drawer slide homing apparatus of claim 1, wherein said fixed base includes a buffer disposed at a position connected to said slide base.

4. The automatic drawer slide homing apparatus of claim 3, wherein said buffer is a rubber pad.

* * * * *